US005651691A

United States Patent [19]

Grumel

[11] Patent Number: 5,651,691

[45] Date of Patent: Jul. 29, 1997

[54] SELF-BARING CONNECTOR

[75] Inventor: Christophe Grumel, Domene, France

[73] Assignee: Schneider Electric S.A., France

[21] Appl. No.: 438,214

[22] Filed: May 9, 1995

[30] Foreign Application Priority Data

May 25, 1994 [FR] France ..... 94 06571

[51] Int. Cl.[6] ..... H01R 4/24

[52] U.S. Cl. ..... 439/417; 439/397; 439/395; 439/465

[58] Field of Search ..... 439/395, 397, 439/398, 404, 405, 417, 422, 389, 391, 400, 401, 407, 425, 426, 499

[56] References Cited

U.S. PATENT DOCUMENTS

| | | | |
|---|---|---|---|
| 4,029,384 | 6/1977 | Reinwall, Jr. | 439/397 |
| 4,089,580 | 5/1978 | Huffnagle et al. | 439/400 |
| 4,211,462 | 7/1980 | Wolfthal | 439/391 |
| 4,326,767 | 4/1982 | Silbernagel et al. | 439/392 |
| 4,612,423 | 9/1986 | Munroe | 439/391 |
| 5,498,172 | 3/1996 | Noda | 439/417 |

FOREIGN PATENT DOCUMENTS

| | | | |
|---|---|---|---|
| 0470887 | 2/1992 | European Pat. Off. | 439/404 |

*Primary Examiner*—Neil Abrams
*Assistant Examiner*—Brian J. Biggi
*Attorney, Agent, or Firm*—Parkhurst, Wendel & Burr, L.L.P.

[57] ABSTRACT

The invention relates to a self-baring connector for a flat cable. This connector comprises a base and a cover fitted onto this base. The base comprises grooves separated by longitudinal bosses and the cover is equipped with grooves separated by longitudinal ribs to house wires of an electrical cable. The cover in addition bears, in recesses arranged in the grooves, connecting grips arranged to perform electrical coupling by perforation of the self-baring type of the insulator surrounding the conductor of the wire. This connector is suitable for a flat cable with several electrical wires and enables an electrical connection to be made at any point of this cable.

7 Claims, 9 Drawing Sheets

SELF-BARING CONNECTOR

BACKGROUND OF THE INVENTION

The present invention relates to a self-baring connector fitted onto a flat cable of the type comprising several insulated electrical wires or several bare conductors, sunk in an insulating sheath, and comprising a base, a cover arranged to be fitted onto the base and connecting grips, whose number is at least equal to the number of insulated electrical wires or bare conductors. The connecting grips are mounted inside a space defined by the base and the cover and arranged to house the flat cable, and provided with at least one self-baring contact part.

European Patent EP-A-470,887 describes a branch connector for a flat cable, in which the self-baring contact presents an H-shaped structure securedly affixed to an intermediate support. The end of each branch is bevelled to form a tapered inlet. Fitting of such a connector is complicated.

Numerous known connectors of the self-baring type are usually used to achieve simple and quick electrical coupling of individual electrical wires or pairs of wires, used for example in telephone installations, with connection terminals. In these applications, the thickness of the insulating layer which surrounds the conductor is small and the conductor itself is fragile. The contact parts housed inside these known connectors have the function of making a cut in the insulator without damaging the conductor to provide an efficient and reliable electrical connection. However, these connectors are not suitable for flat wires and can only be used for individual wires and not for strips of wires sunk in a flat insulating ribbon cable.

SUMMARY OF THE INVENTION

The object of the invention is to overcome the above described shortcoming of known connectors and to achieve a connector enabling electrical power transportation cables comprising several electrical wires arranged in a flat strip to be connected efficiently and reliably.

This object is achieved in accordance with the present invention by a connector wherein connecting grips are mounted inside a cover. Each connecting grip comprising a base equipped with two self-baring contact parts each comprising two parallel branches separated from one another by a distance equal to or slightly smaller than the diameter of a conductor of the corresponding electrical wire. Furthermore, each branch of the self-baring contact part is provided with a spike arranged to perforate the insulation surrounding the conductor, and a withdrawn section which defines with the corresponding section of the other branch an enlarged zone arranged to receive the conductor of the electrical wire and in which the electrical coupling between the conductor and the corresponding connecting grip is made.

According to a particular embodiment of the invention the base and cover are respectively provided with grooves respectively separated by longitudinal bosses and longitudinal ribs. These grooves are arranged to cooperate with each other to house one of said electrical wires, and the longitudinal bosses and longitudinal ribs are arranged to cooperate and bear on connection bridges separating the wires of the flat cable.

BRIEF DESCRIPTION OF THE DRAWINGS

The present invention will become more clearly apparent from the following description of a preferred embodiment given as a non-restrictive example only and represented in the accompanying drawings in which:

FIG. 7 represents a front view of the connecting grip of FIG. 6, and.

DETAILED DESCRIPTION OF THE PREFERRED EMBODIMENT

Figure 1:
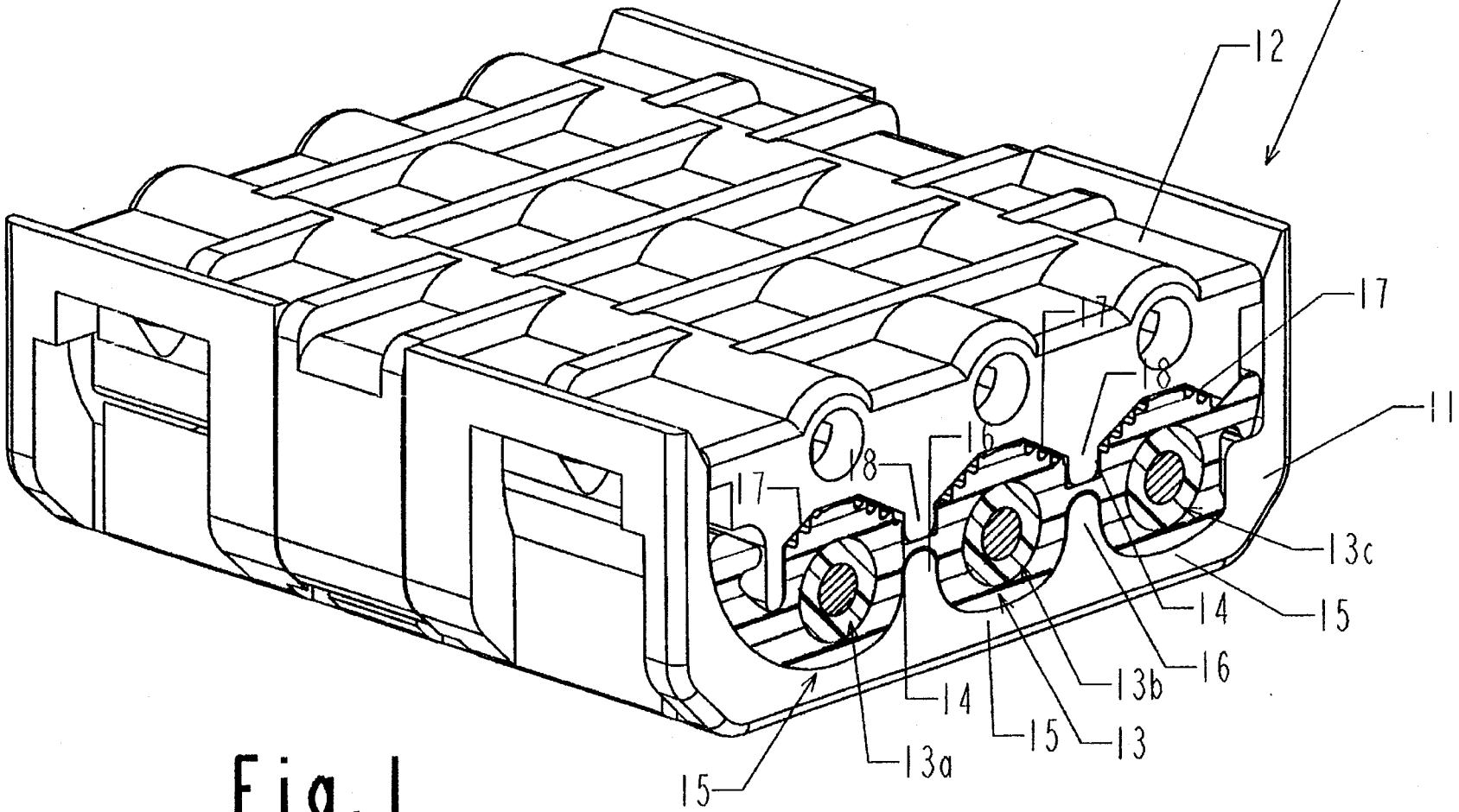
FIG. 1 represents a perspective view of a self-baring connector for a flat cable according to the invention.

With reference to the figures and notably to FIGS. 1 to 5, the self-baring connector 10 includes a bottom part or base 11 and a top part or cover 12 arranged to be fitted together so as to clamp a flat cable 13. Cable 13 is composed, in the non-restrictive example represented, of three insulated wires 13*a*, 13*b* and 13*c* coated in a layer of synthetic insulating material which surrounds the three wires and forms two connecting bridges 14. The base 11 of the connector 10 presents a suitable profile to receive the cable 13. For this purpose, it comprises three grooves 15 which define recesses accommodating the three wires 13*a*, 13*b* and 13*c*. Grooves 15 are separated by longitudinal bosses 16 whose apexes act as bearing surfaces for the connecting bridges 14 of the cable 13. The cover presents a similar geometry and comprises three grooves 17 designed to receive the wires 13*a*, 13*b* and 13*c* of the cable 13, and more specifically, the upper half of wires 13*a*, 13*b* and 13*c*. The grooves 17 are separated by longitudinal ribs 18 which bear on the bridges 14.

Figure 2:
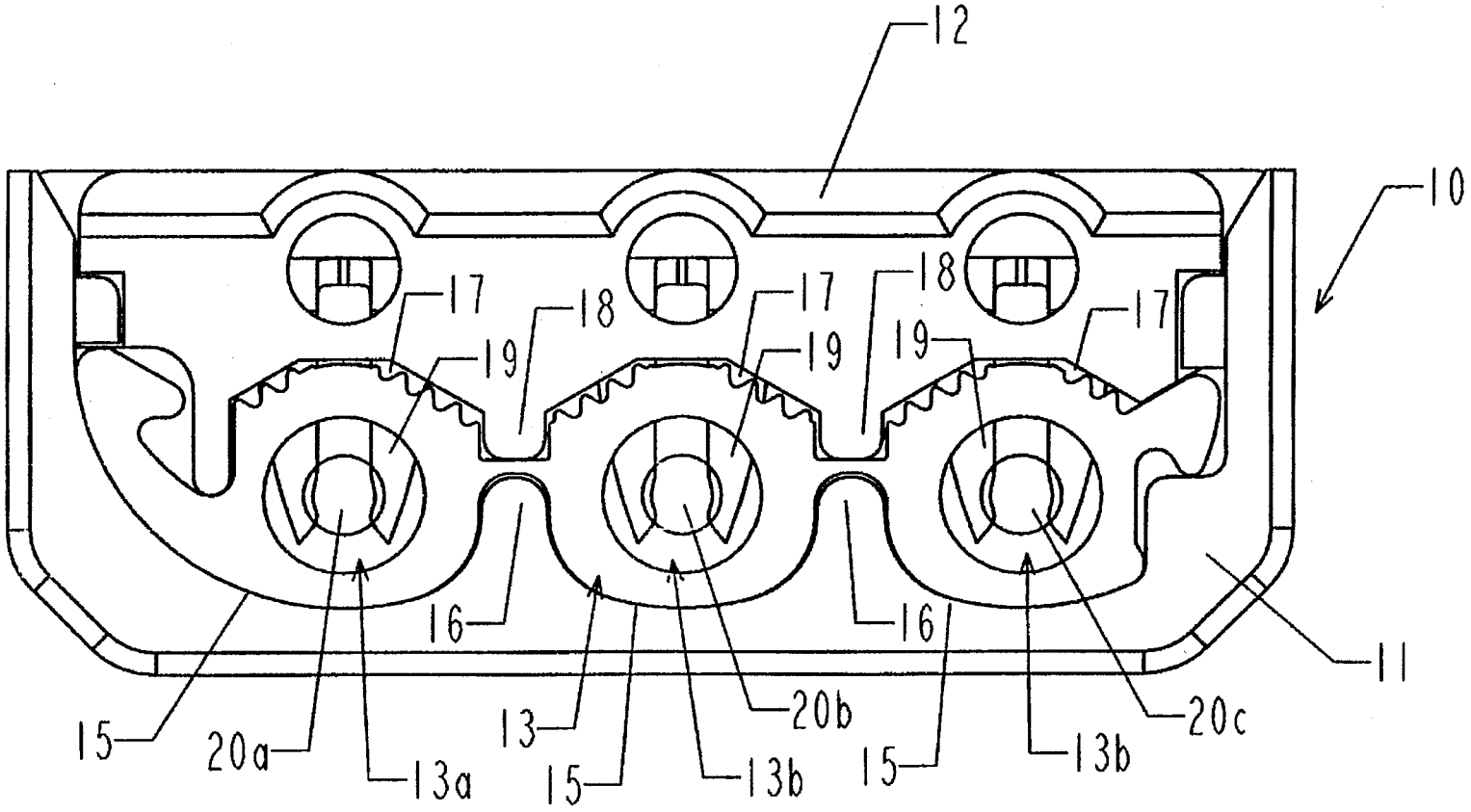
FIG. 2 is a front view of the connector of FIG. 1.

As is shown in FIG. 2, the connector 10 is equipped with connecting grips 19 which are arranged to ensure electrical coupling of the conductors 20*a*, 20*b* and 20*c* of the corresponding wires 13*a*, 13*b* and 13*c* with terminal blocks securedly united to the connector 10. The grips 19 are mounted inside the cover 12, preferably by clipping into housings arranged for this purpose and achieved by moulding.

Figure 3:
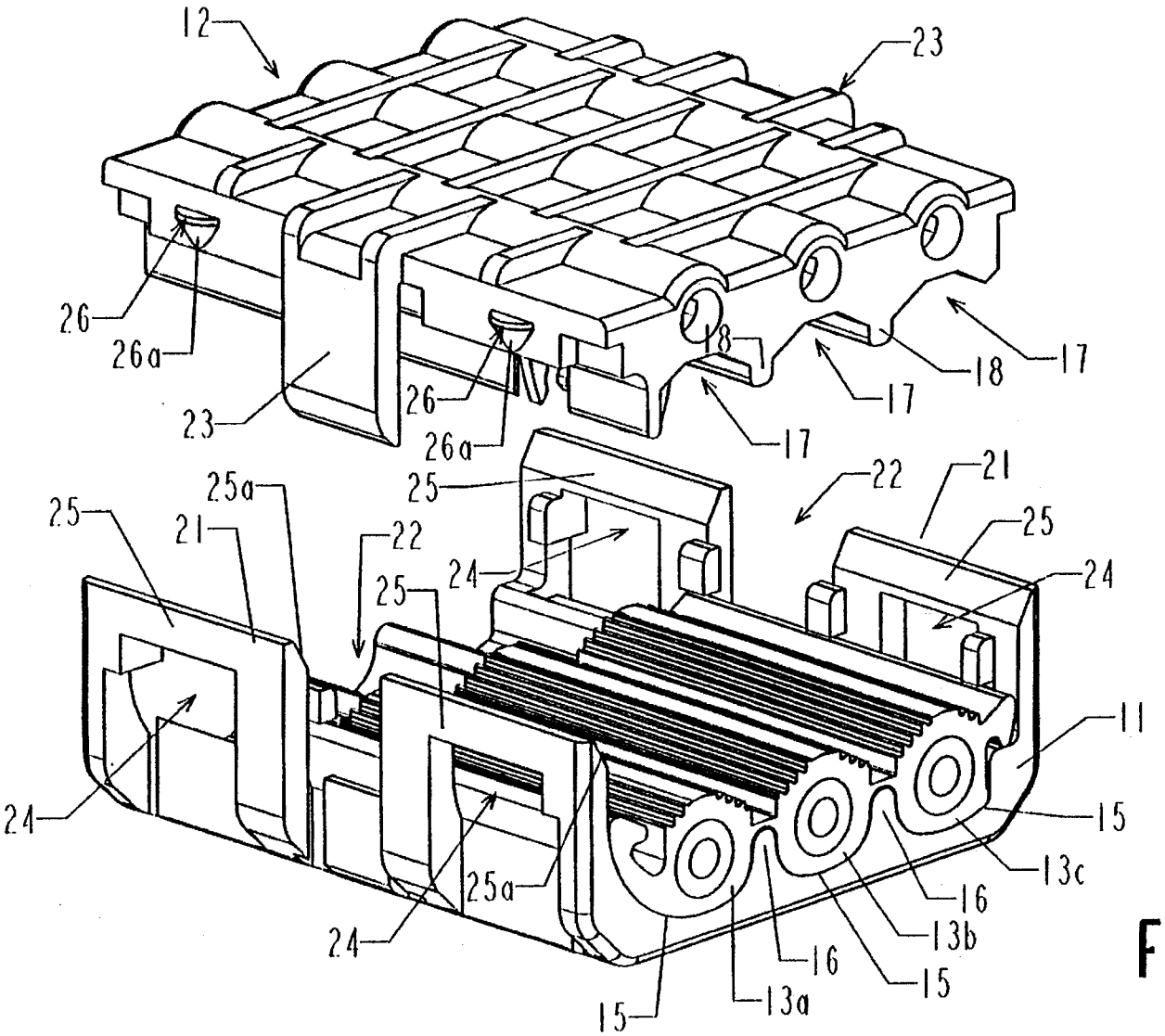
FIG. 3 is an exploded perspective view of the connector of FIGS. 1 and 2.
Figure 4:
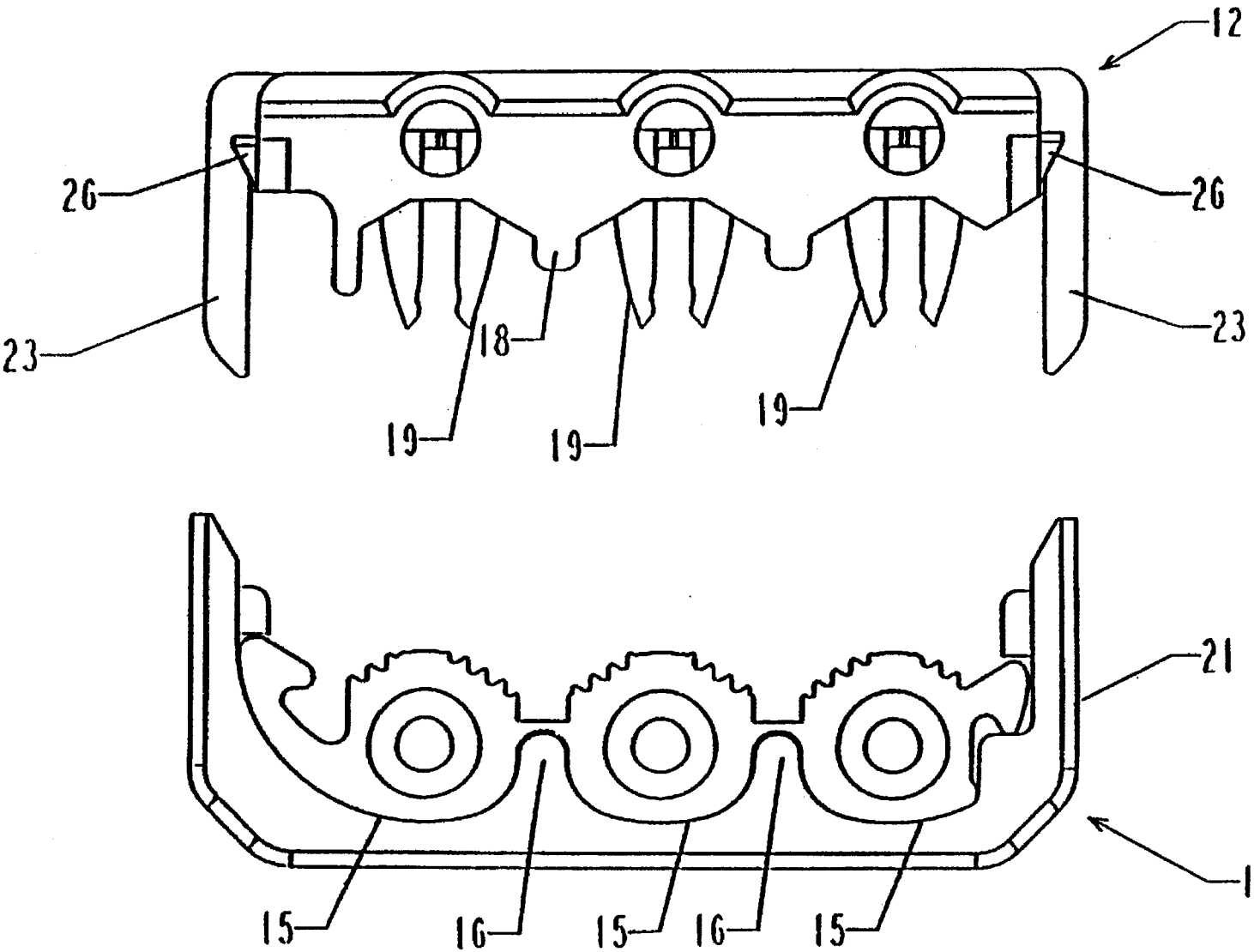
FIG. 4 is a front view of the connector of the previous figures, before final assembly of its bottom part and its top part.

As is shown in FIG. 3, the base 11 has two raised side edges 21 each provided with at least one central slot 22. These two slots have a complementary profile to that of the two lateral extensions 23 of the cover 12. When the cover 12 is fitted on the base 11, the lateral extensions 23 engage in the central slots 22. In addition, the raised side edges 21 of the base 11 have the form of U-shaped arches 24 whose upper segments 25 are arranged to cooperate with protuberances 26 of the cover, having a triangular cross-section to perform clip-fastening when the cover 12 is fitted onto the base 11 thus locking cover 12 in position. To enable this clip-fastening, the protuberances 26 present an inclined ramp 26*a* which constitutes an attacking edge and which cooperates with the inclined edge 25*a* of the upper segments 25 of the arches 24.

To place a connector 10 at a selected place on the cable 13, the base 11 is first positioned under the cable 13 in such a way that the wires 13*a*, 13*b*, 13*c* enter the receiving recesses defined by the three grooves 15, and the cover 12 is then fitted onto the base 11. This operation ensures automatic electrical coupling of the conductors of the cable wires in a manner which will be described in detail herebelow.

It should be noted that the number of grooves 15 is not limited to three, but can extend to any number, notably five, when the cable is intended to carry three-phase electrical current and comprises five coated wires.

Figure 5:
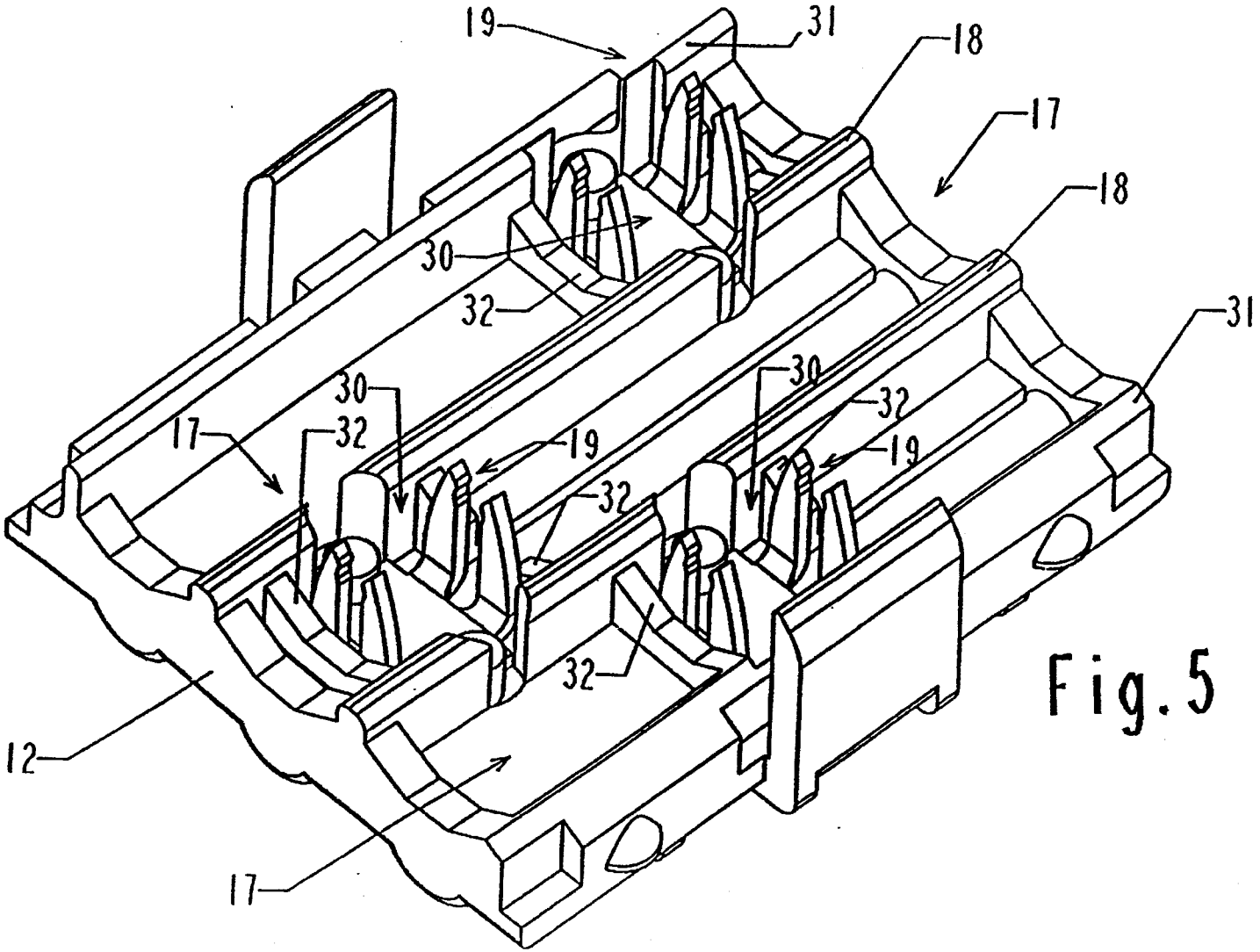
FIG. 5 represents a perspective view illustrating the inside of the top part of the connector of the previous figures.

FIG. 5 shows the cover 12 equipped with three double connecting grips 19. One of these grips 19 is represented by the perspective view of FIG. 6. These three grips 19, which correspond to the three wires 13*a*, 13*b* and 13*c* of the cable 13, are shown respectively in the three grooves 17 and more particularly in limited recesses 30 inside grooves 17. The recesses 30 are bounded by the longitudinal ribs 18, the side edges 31 of the cover 12 and by the transverse partitions 32. The grips are engaged by force in the recesses 30 whose walls are all made in one part by moulding when the cover is manufactured.

Figure 6:
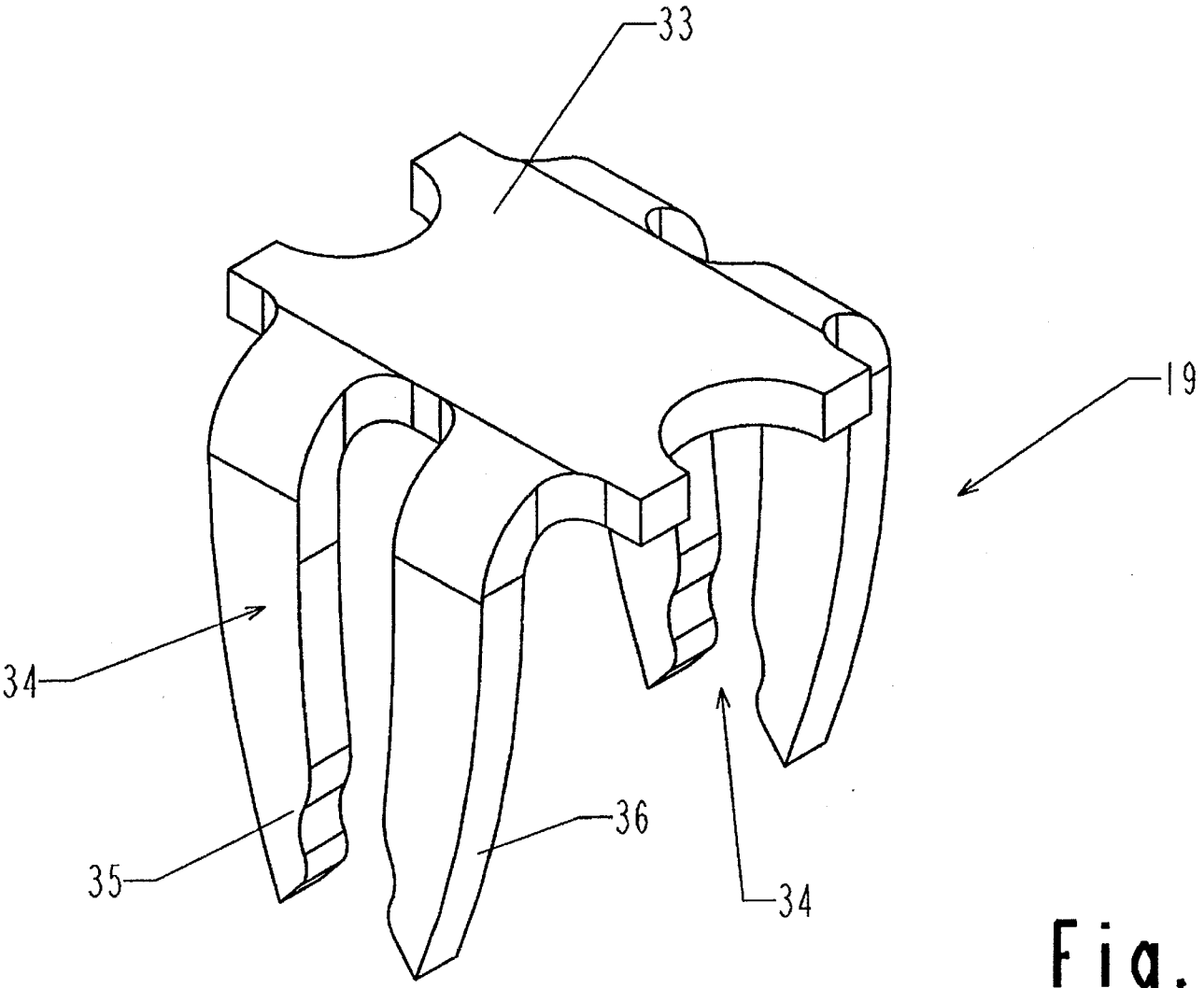
FIG. 6 represents a perspective view of a connecting grip of the connector of the previous figures.

As shown in FIG. 6, each grip 19 comprises a base 33 which bears two self-baring contact parts 34. The base 33 and the two contact parts are made from a metal part by stamping-folding. Each self-baring contact part 34 comprises two parallel branches 36 separated from one another by a mean distance which is equal to or preferably slightly smaller than the diameter of the conductors 20*a*, 20*b* and 20*c* of the wires 13*a*, 13*b* and 13*c*. The contact parts 34 are secured affixed to two opposite sides of the base 33 and have an orientation appreciably perpendicular to the plane of the base 33.

Figure 7:
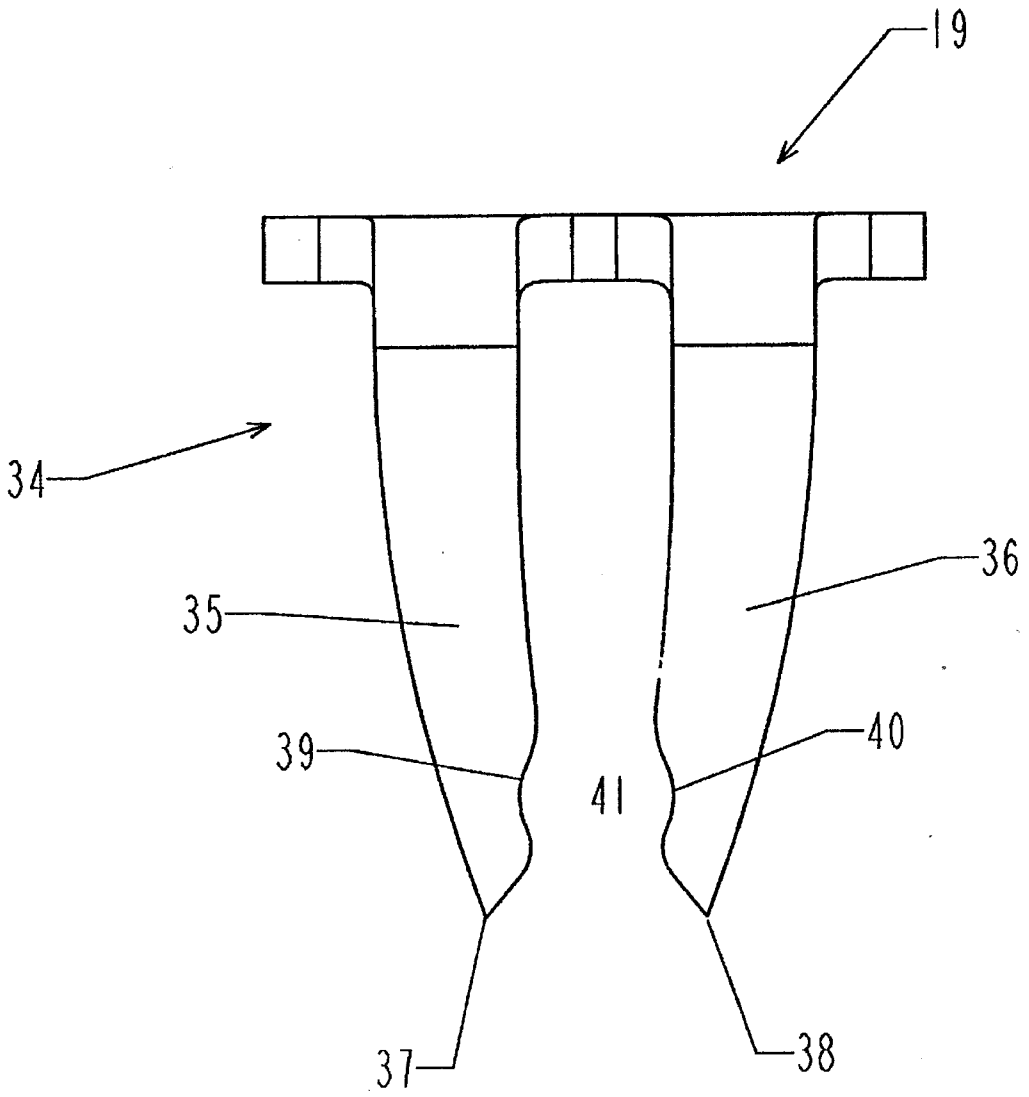

The profile of the self-baring contact parts 34 is apparent from FIG. 7. The opposite branches 35 and 36 each include, at its free end, a spike 37, 38 which penetrate into the thickness of the insulation surrounding the conductors 20*a*, 20*b*, 20 *c* of the wires 13*a*, 13*b*, 13 *c*. Each spike 37, 38 is connected to a withdrawn section 39, 40 which defines, with the corresponding section of the other branch, a slightly enlarged zone 41 of the slot defined between the two branches 35 and 36.

Figure 8:
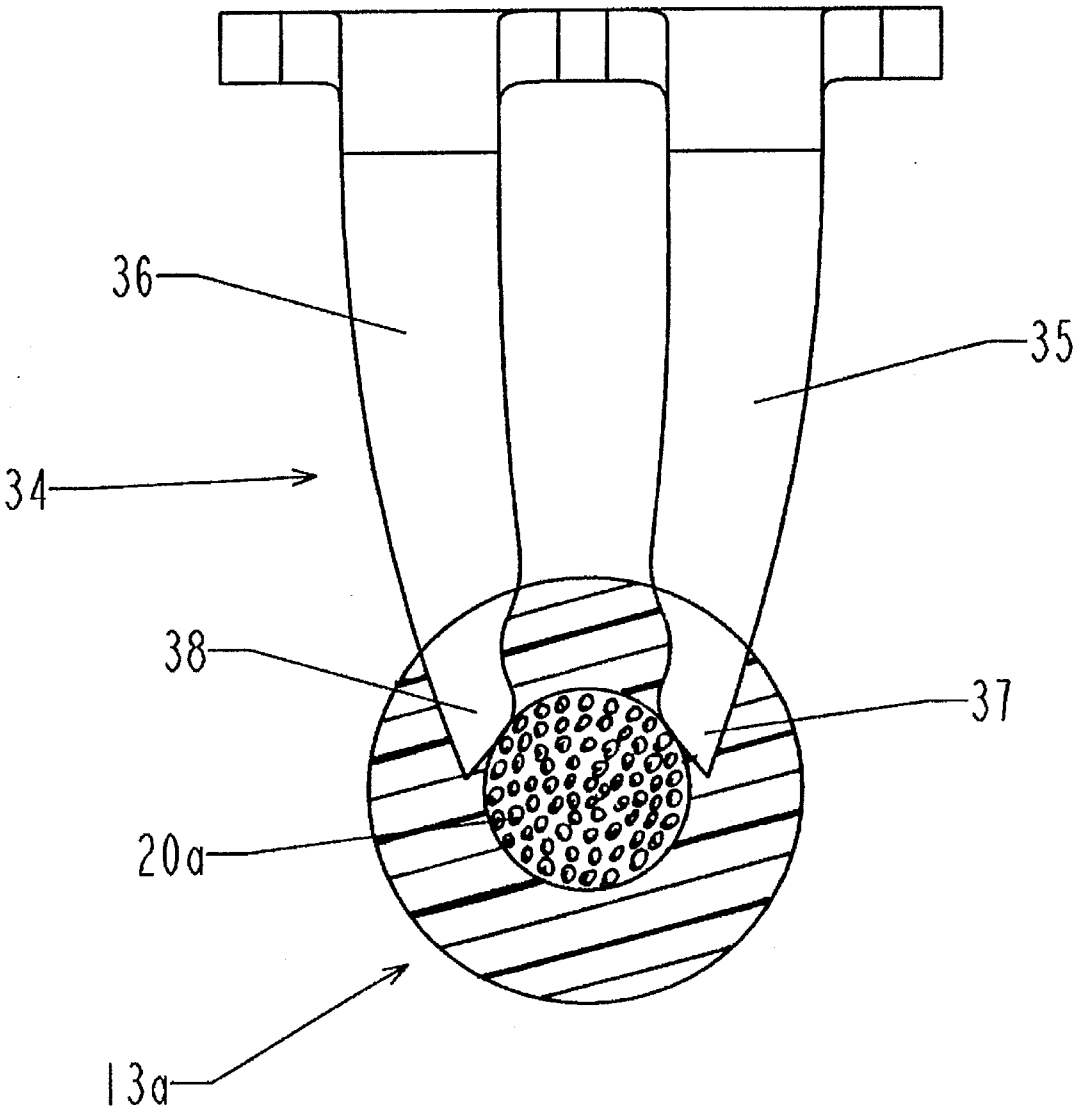
FIGS. 8 and 9 illustrate two successive phases of fitting and connection of a flat cable inside a connecting grip of a connector according to the invention.
Figure 9:
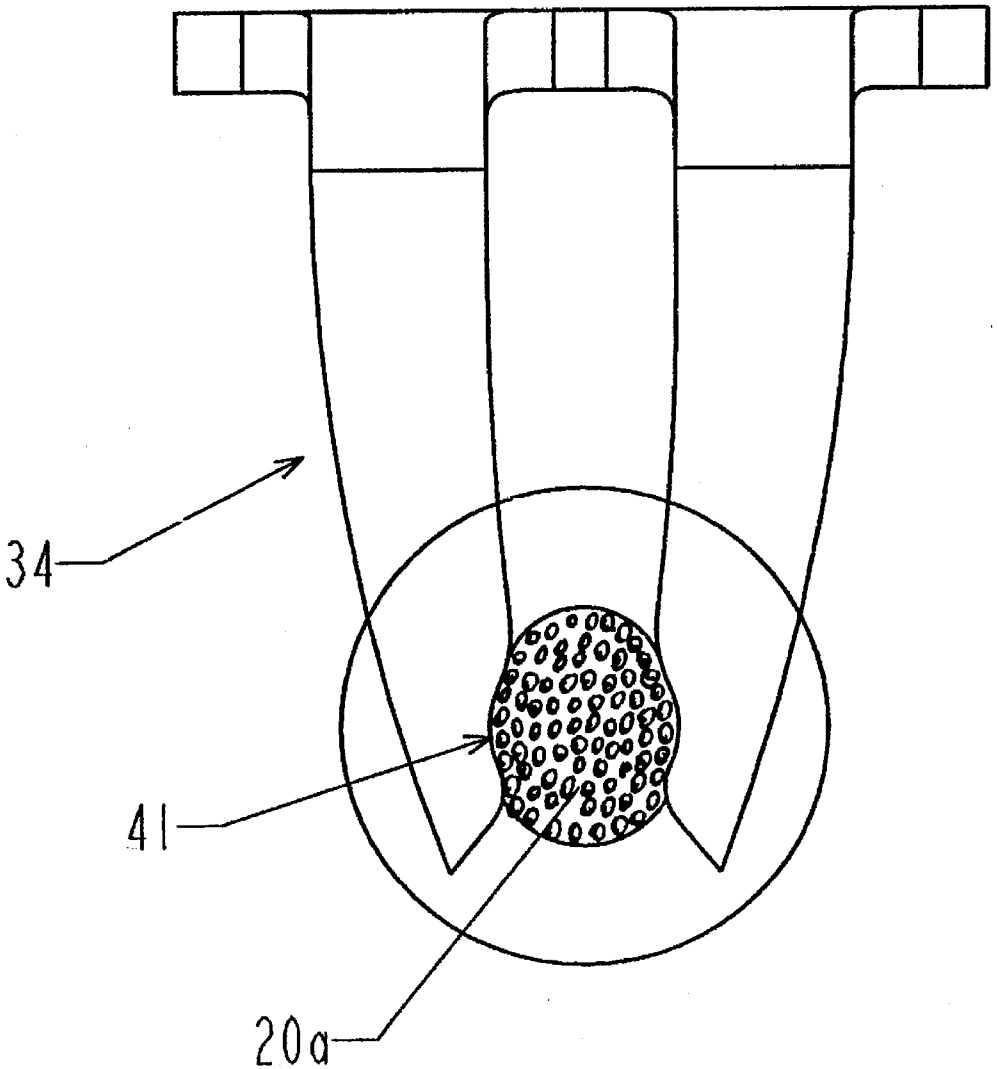

FIGS. 8 and 9 illustrate the function of the contact parts 34 in an initial and a final phase of connector use. In the phase represented by FIG. 8, the external insulation of the cable 13 has already been perforated by the spikes 37 and 38 which have also penetrated into the insulating layer surrounding the conductor 20*a* of the wire 13*a*. The inside edges of the spikes 37, 38 come into contact with the conductor 20*a*, which has the effect of slightly separating the two branches 35 and 36 from the contact part 34 when the cover 12 bearing contact part 34 is pushed onto base 11 of the connector 10*a*. FIG. 9 shows that this relative movement of the conductor 20*a* and contact part 34 has the effect of slightly deforming the conductor 20*a* which finally positions itself in the enlarged zone 41, defined with reference to FIG. 7. Due to this deformation and the existence of the enlarged zone, the electrical coupling between the contact part and the conductor is achieved satisfactorily without baring any insulation prior to connection.

The connecting grips 19 are preferably made of an electrically conducting material, such as, for example, a copper-beryllium alloy which has acceptable characteristics for electrical conductibility, flexibility and creep strength.

Assembly of the cover 12 on the base 11, which is performed at the same time as the coupling operation of the electrical wires 13*a*, 13*b*, 13*c* by self-baring connection, is achieved by means of special pincers. The connection 10 can be equipped with various connection terminals including screws, or welded or crimped terminals.

The main advantage of this connector is that it can be fitted at any point of the cable and that it enables an electrical connection to be made on the cable 13 in an efficient, fast and reliable manner, without any direct action on the cable 13.

The present invention is not limited to the embodiments described above, but can undergo different modifications and be presented in various alternative embodiments obvious for those skilled in the art.

I claim:

1. A self-baring connector for a flat cable having several conductors encased in an insulating sheath, comprising:

a base;

a cover arranged to be fitted onto said base; and a plurality of connecting grips at least equal in number to the number of conductors of the flat cable, and mounted inside said cover and enclosed inside a space defined by said base and said cover when said cover is fitted onto said base, each of said connecting grips comprising a base equipped with two self-baring contact parts each comprising two parallel branches separated from one another by a distance equal to or slightly smaller than the diameter of the conductors and each having a top portion and a bottom portion, each branch of said self-baring contact part having (i) a spike, at said bottom portion, arranged to perforate the insulating sheath surrounding the conductors, and (ii) a withdrawn section, located between said top portion and bottom portion, which defines, with a corresponding section of the other branch and with respect to a slot formed by said two branches, an enlarged zone arranged (a) to receive one of the conductors and (b) to electrically couple said one of the conductors and the connecting grip.

2. The connector of claim 1, wherein said base and cover are respectively provided with grooves respectively separated by longitudinal bosses and longitudinal ribs, such that the grooves are arranged to cooperate in pairs to house one of the conductors, and said longitudinal bosses and longitudinal ribs are arranged to cooperate and bear on connection bridges separating the conductors of the flat cable.

3. The connector of claim 2, wherein said connecting grips are each housed in a recess bounded inside said grooves by transverse partitions.

4. The connector of claim 1, wherein said connecting grips are made of metal by stamping-folding.

5. The connector of claim 1, wherein said base comprises two raised side edges provided with at least one central slot, and said cover comprises two lateral extensions each arranged to be engaged respectively in said central slot of said base.

6. The connector of claim 5, wherein said raised side edges have the form of U-shaped arches whose upper segments are arranged to cooperate with protuberances of said cover to lock said cover in position on said base.

7. The connector of claim 6, wherein said protuberances present an inclined ramp constituting an attacking edge to Cooperate with inclined edges of upper segments of said raised edges of said base.

* * * * *